United States Patent [19]

Farmer

[11] 4,296,904

[45] Oct. 27, 1981

[54] ELECTRICAL EQUIPMENT MOUNT

[75] Inventor: Marion R. Farmer, Germantown, Tenn.

[73] Assignee: Aluma Form, Inc., Memphis, Tenn.

[21] Appl. No.: 65,076

[22] Filed: Aug. 9, 1979

[51] Int. Cl.[3] ..... E04G 3/00

[52] U.S. Cl. ..... 248/218.4; 52/40; 52/697

[58] Field of Search ..... 248/219.2, 219.4, 219.1, 248/218.4, 219.3; 174/45 R, 40 R, 149 R; 52/40, 697, 721; 211/107

[56] References Cited

U.S. PATENT DOCUMENTS

| | | | |
|---|---|---|---|
| 2,990,151 | 6/1961 | Phillips | 211/107 |
| 3,374,978 | 3/1968 | Salmon et al. | 248/219.4 X |
| 3,497,171 | 2/1970 | Farmer et al. | 174/45 R X |
| 3,507,975 | 4/1970 | Scott | 211/107 X |
| 3,653,622 | 4/1972 | Farmer | 211/107 |
| 3,704,001 | 11/1972 | Sloop | 248/219.4 |
| 3,750,992 | 8/1973 | Johnson | 211/107 |
| 3,856,250 | 12/1974 | Farmer | 211/107 |
| 4,127,739 | 11/1978 | Farmer | 248/219.3 X |

*Primary Examiner*—J. Franklin Foss
*Attorney, Agent, or Firm*—Paul M. Denk

[57] ABSTRACT

An electrical equipment mount designed for providing angulated mounting of transformers or other electrical equipment to the utility pole, wherein one or more crossarms are suspended from the utility pole by means of a pole gain, bearing plate, or other fastener, with a transformer mounting bracket being suspended forwardly of the crossarms through a pair of braces, while a pair of particularly designed angled connectors secure to the bevel ends of the crossarm(s) for securing transformers at both of its ends and at angulated dispositions that face them generally in a direction towards the front of the mount.

9 Claims, 4 Drawing Figures

FIG. 1.
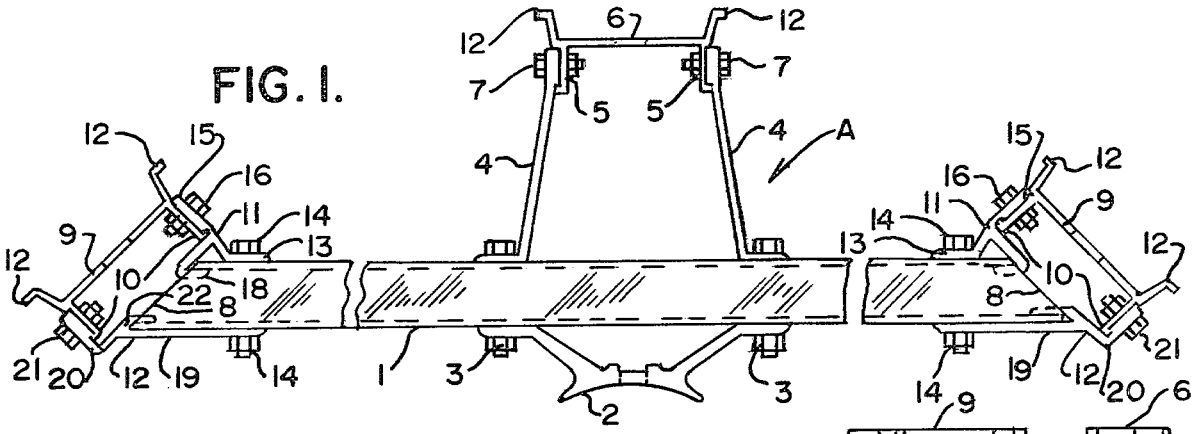
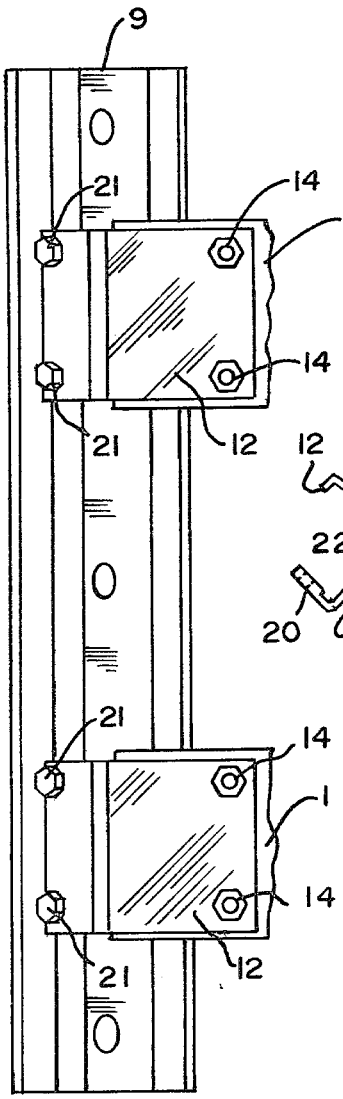
FIG. 2.
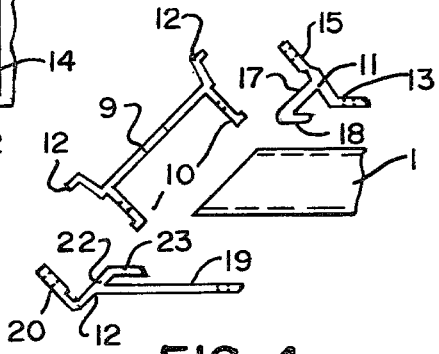
FIG. 4.
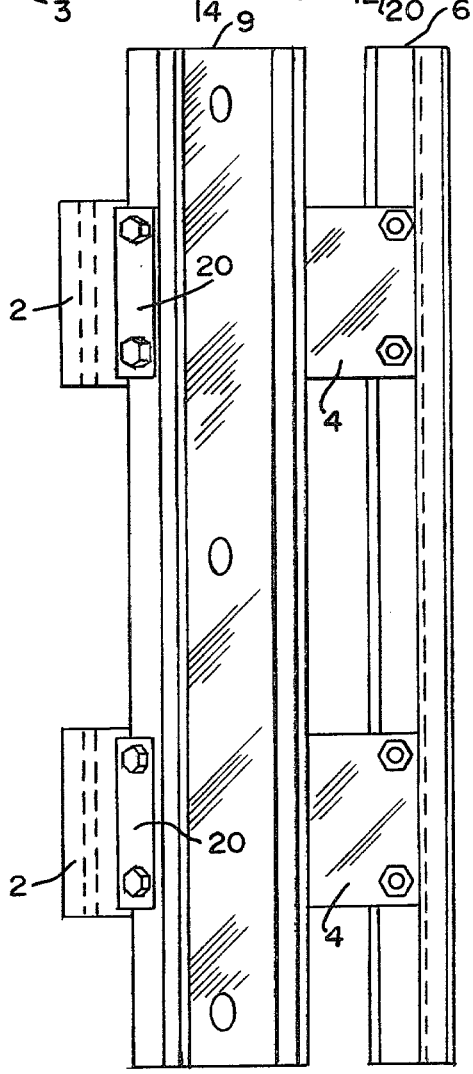
FIG. 3.

ELECTRICAL EQUIPMENT MOUNT

CROSS-REFERENCE TO RELATED PATENT

The invention of this application relates to the equipment mount shown in my prior U.S. Pat. No. 3,856,250, which issued on Dec. 24, 1974; both this application and said earlier patent being owned by a common assignee.

BACKGROUND OF THE INVENTION

This invention relates generally to an improved electrical equipment mount, and one which is particularly designed and constructed to provide for transformers or other electrical equipment to be mounted to its crossarm and arranged facing forwardly to facilitate their installation and maintenance, while enhancing the structural appearance of the assembly in usage.

It has become very desirable as a matter of convenience, and for efficiency, to mount a plurality of electrical components, such as distribution transformers, upon a single cluster mount upon a utility pole. Heretofore, or at least not too many years ago, the common practice was to mount a single transformer upon the utility pole for service in just the immediate area, but now, as can be seen from my prior patent, just previously described, that it becomes more advantageous, primarily from a cost standpoint, to mount a cluster of transformers upon a single electrical equipment mount. When it became in vogue to mount a plurality of such equipment upon a single bracket, and due to the significance of weight of electrical equipment in the category of transformers, prior art mounting apparatuses of this type were devised primarily to provide structural support for such a variety of equipment, and as a result, the apparatuses were then devised by what was considered a design necessity of heavy, press-molded metal plates, such as shown in the U.S. Pat. No. 2,879,694, that issued to R. R. Anderson. While these prior art devices are more than likely effective for the mounting of the numerous electrical equipment attached to them, as a result of the size of the equipment involved, and the structural bulkiness and heaviness of the bracket components, it was a rather difficult if not an altogether burdensome task for a utility man to elevate and attach such mounts to the utility pole. To overcome such a problem, some consideration was given to reducing the component size of such electrical devices, and such is shown in the U.S. Pat. No. 2,990,151 to D. M. Phillips, wherein a pair of channel braced by elongated angle members are shown.

Earlier consideration was given to weight reduction in the fabrication of such electrical equipment mounts, and such is shown in the U.S. Pat. No. 3,374,978 to J. L. Salmon, which gave recognition to the advantages that can be obtained by interlocking light weight aluminum parts together into an electrical equipment support, and one that could be easily lifted and suspended from the utility pole by a single worker. It is to be noted that this patent to Salmon also belongs to a common assignee of the prior patent to myself and this current application. Such devices, as shown, are generally constructed of light weight aluminum, and where they sacrifice strength characteristics by being constructed of a lighter weight material, such weakness is easily compensated for through the use of interlocking components that provide added strength to the fabricated equipment mount when assembled. The current invention comprises yet a further improvement upon the prior art teachings in this field of equipment mounts, and not only provides the interlocking relationship for the various components constructed into its mounting, but likewise, gives consideration to the convenience to be obtained from the proper positioning of the transformers upon the cluster mount so that they will generally be oriented usually towards the front of the invention, and thereby facilitate both transformer installation, and maintenance by a single utility man.

It is therefore, the principal object of this invention to provide an improved electrical equipment mount that attains significant strength due to the interlocking relationship of its various components, and which is also constructed in the manner that provides for convenience in the mounting and positioning of the transformers and related electrical equipment towards the front of the cluster mount.

Another object of this invention is to provide a series of connectors that provide for a total interlocking relationship between the crossarm and the transformer mounting pads so that enhanced strength for equipment support is attained even though such components are fabricated from light weight aluminum or similar type materials.

Yet another object of this invention is to provide connector means that hook around and interlock with the beveled ends of a crossarm to provide enhanced locking strength for the mount in the suspension of transformers at these locations.

A further object of this invention is to provide interlocking components for forming an equipment mount and which conveniently disposes such mounted equipment preferably towards the front of the crossarm, thereby facilitating their maintenance, while likewise enhancing the overall component appearance during usage.

Other objects will become more apparent to those skilled in the art upon reviewing the following summary, and upon undertaking a study of the description of the preferred embodiment in view of its drawings.

SUMMARY OF THE INVENTION

This invention contemplates the formation of a cluster mount of the type that incorporates one or a pair of crossarms that mount to a utility pole through the agency of a pole gain or other type of fastener. The crossarm may be of linear design, or be curved or angled, whichever may be suitable for the particular location for installation and the type of equipment to be suspended. Examples of the curved type of crossarm is shown in my said prior U.S. Pat. No. 3,856,250.

The crossarms utilized in this cluster mount may be formed of channel stock, or even of a box channel, as shown in the drawing, and preferably will be constructed of a light weight material, such as aluminum, in order to lessen the effort required to be exerted during its installation. The improvement of the invention is the provision of the angulated mounting of those brackets or mounting pads normally associated with the ends of the crossarm, and in this instance, it is the uniquely formed connectors and their method of fastening to the beveled ends of the crossarm that assure an interlocking relationship with their associated mounting pad, and their rigid fastening to the crossarm ends. These connectors are formed having a series of legs, generally angled with respect to each other, and an integral tab means that hooks around the exposed end edges of the front and back surfaces of the crossarm for insuring rigidity in the suspension of the mounting pads, and their eventually secured transformers, safely to the utility pole.

In addition to the foregoing, and due to the angulated disposition of the mounting pads particularly at the ends of the crossarm toward the front of the cluster mount, the ease with which the utility man may work upon two of the proximate transformers at one time is greatly enhanced, in addition to presenting a cluster of transformers that are rather pleasing in appearance due to their forwardly disposed relationship upon the utility pole in this manner. Likewise, with all the transformers being angled towards the front of the utility pole, this allows abundant clearance for the utility man should he desire to adjust his ladder against or climb upon the back side of the pole to perform his maintenance work, since the highly charged distribution transformers will be facing in a direction opposite from his position of work located upon the rear of the utility pole. In certain jurisdictions, such as in California, there are regulations that dictate the amount of clearance for working space for the utility man that must be provided at the level of installation of the electrical equipment cluster mount. This particular invention, due to its inherent design, readily provides compliance with such regulations, and therefore immediately meets with their approval.

BRIEF DESCRIPTION OF THE DRAWING

In the drawing,

FIG. 1 provides a plan view of the electrical equipment cluster mount of this invention;

FIG. 2 provides a front view of one end of the mount, showing its mounting pad and rear connectors holding the same to the ends of a pair of crossarms;

FIG. 3 provides a right side view of the equipment mount shown in FIG. 1; and FIG. 4 furnishes an exploded top view of one end of the equipment mount showing the relative position of the mounting pad, the front and back connectors, and part of the proximate end of a crossarm.

DESCRIPTION OF THE PREFERRED EMBODIMENT

In referring to the drawing, and in particular FIG. 1, there is shown the electrical equipment mount A of this invention comprising at least one crossarm 1, which, as previously explained, may be fabricated from channel stock, and being either an open channel, as for example, with the opening of the channel facing downwardly, or being formed more preferably of box channel material, and of a light weight metal, such as aluminum. Connecting with the crossarm is a pole gain or bearing plate 2, secured therewith by means of the fasteners 3, with the arcuate portion of the gain disposed for resting against and being secured with the utility pole (not shown). Extending forwardly from the front of the crossarm 1 are a pair of brace means 4, being connected with the crossarm also by the fasteners 3, while the front of the brace means interlock with the C-shaped flanges 5 of the bracket or transformer mounting pad 6. Fasteners 7 provide for securing of the bracket with the brace means 4.

Both ends of the crossarm, as at 8, are cut along an angle, so as to provide their facing generally in a more forwardly direction, as can be seen, and secured with each angulated end of the crossarm is another bracket or transformer mounting pad 9, as shown. Each bracket 9 also includes a pair of integral C-shaped flanges 10 extending rearwardly thereof, and these are designed for mating with the front connectors 11 and rear connectors 12 that rigidly interlock and secure the brackets 9 with these angled ends of the crossarm, as previously explained. Thus, when transformers are mounted to the front flanges 12 of each of the brackets 6 and 9, they are generally disposed in a front facing direction to obtain the advantages as previously summarized. Although, the same connectors can be utilized for mounting the transformers also towards the rear or the sides of the equipment mount.

In referring to FIG. 4, the front connector 11 includes a first leg 13 that extends generally inwardly of the equipment mount, and is secured through the agency of the fastener means 14 abutting against the front surface of the crossarm 1. A second leg 15 extends angularly with respect to the leg 13 of the connector 11, and includes a boss-like portion that interfits within the C-shaped flange 10 of the bracket 9, interlocking therewith, and is rigidly secured thereto by means of the fastener 16. An integral tab 17 projects from the connector 11, and includes a bent end 18, which is designed for hooking around the beveled forward end edge of the crossarm 1 to enhance the interlocking characteristics between the connector and said crossarm, and thereby further reinforce the resistance of the bracket against bending when heavy distribution transformers may be secured therewith. Preferably the height of the tab 17 and its bent end 18 will be just slightly less than the internal height of the crossarm 1, so that the binding of the end 18 against the inner upper and lower surfaces of the crossarm 1 will further enhance the interlocking strength of the connector with the crossarm, and be a resistance against the bending moments exerted upon the same as a result of the weight of the mounted transformer.

The rear connector 12 of the equipment mount includes a first leg 19 which is also abutted against the back surface of the crossarm 1, and secured thereto by means of the same fastening means 14. A second leg 20 of the connector 12 angles slightly forwardly in the connector's structural relationship, and includes a boss-like portion that interfits within the approximate C-shaped flange 10 of the bracket 9. A fastener 21 secures through these two components to further enhance their interlocking relationship and provide a permanent union during usage. A tab-like member 22 integrally extends from the first and second legs 19 and 20, and also includes a bent end 23 that hooks into the interior of the crossarm 1, and is designed having the same height and other relationship with respect to the crossarm as explained with respect to the tab 17, in order to enhance the strength of the connection of the bracket 9 with the angled end of the crossarm at this location.

As can be seen from FIGS. 2 and 3, where the distribution transformers are of significant size, a pair of crossarms 1 may be mounted to the utility pole through the agency of one or more of the pole gains 2, having the mounting pads or brackets 6 and 9 extending between and securing with the end connectors 11 and 12 associated with each crossarm. Thus, heavier distribution transformers may be supported upon the equipment mounts of this design as shown in FIGS. 2 and 3, but with the equipment mount incorporating the same interlocking components for insuring the rigid and secure mounting of such electrical equipment. And, such permanent mounting is assured even when the electrical equipment should encounter rather rough weather conditions, such as snow and wind loads to which they are frequently exposed.

Numerous variations of the construction of this invention may occur to those skilled in the art upon reviewing the summary and description of this disclosure. Such variations, if within the spirit of this invention, are intended to be protected by any claims to patent protection issuing hereon. The specific construction and description of the preferred embodiment is set forth for illustrative purposes only.

Having thus described the invention what is claimed and desired to be secured by Letters Patent is:

1. An improved electrical equipment mount for holding transformers or related electrical equipment and for attachment to a utility pole, the mount being formed from components that interengage to provide enhanced structural support, comprising, a horizontally disposed crossarm, said crossarm fabricated having a channel member and including front and back surfaces and end edges, means for holding said crossarm to a utility pole, a bracket having a mounting pad connecting to each end of the crossarm, said bracket being mounted to the crossarm and disposed for orienting its held transformer towards the front, rear, or side of the equipment mount, each crossarm end being formed to accommodate the mounting of its associated bracket in its desired disposition, connectors securing with the front and back edges of each end of the crossarm for securing its respective bracket to the crossarm end, the connector securing with the back end edge of the crossarm including a first leg, said leg provided for abutting against the back surface of the crossarm and capable of being secured thereto, an integral second leg extending angularly from the first leg of the connector, and said second leg securing with the bracket for retention of the same.

2. The invention of claim 1 and wherein each bracket being mounted angularly to the crossarm and disposed for orienting its held transformer towards the front of the equipment mount, and each crossarm end being formed along a bevel to accommodate the flush mounting of its associated bracket in its angular disposition.

3. The invention of claim 1 and including a pair of brace means mounted approximately centrally to the front of the crossarm, and a bracket connecting with the brace means, whereby said bracket being disposed for securing another transformer centrally to the equipment mount.

4. The invention of claim 1 and wherein said bracket includes at least one rearwardly extending C-shaped flange, and said second leg of the connector shaped having a boss portion for interlocking with said bracket flange, and fastening means securing the C-shaped flange to the said leg boss portion.

5. The invention of claim 1 and including an integral tab securing with one of the legs of the connector and disposed for hooking around the back end edge of the crossarm for insuring retention of the bracket with respect to the same.

6. The invention of claim 1 and wherein the connector securing with the front end edge of the crossarm includes a first leg, said leg provided for abutting against the front of the crossarm and capable of securing thereto, an integral second leg extending from the first leg of the connector, said second leg securing with the bracket for retention of the same.

7. The invention of claim 6 and wherein said bracket includes a rearwardly extending C-shaped flange, and said second leg of the front connector shaped having a boss portion for interlocking with said bracket flange, and fastening means securing the C-shaped flange to the said leg boss portion.

8. The invention of claim 6 and including an integral tab securing with one of the legs of the connector and disposed for hooking around the front end edge of the crossarm for insuring retention of the bracket with the same.

9. The invention of claim 1 and including a pair of crossarms being parallel disposed and securing with the utility pole, said brackets extending vertically, one of each bracket being connected to vertically aligned ends of the crossarms and being mounted angularly with respect thereto, and a pair of connectors securing with the front and back surfaces at each end of the crossarms for securing the proximate brackets angularly to the said crossarm ends.

* * * * *